US008117676B1

(12) United States Patent
Cardoso

(10) Patent No.: US 8,117,676 B1
(45) Date of Patent: Feb. 21, 2012

(54) HARDHAT WITH VENT STRIP AND LIGHTING CONFIGURATION

(76) Inventor: Jefferson Cardoso, Rifle, CO (US)

( * ) Notice: Subject to any disclaimer, the term of this patent is extended or adjusted under 35 U.S.C. 154(b) by 630 days.

(21) Appl. No.: 12/315,345

(22) Filed: Dec. 1, 2008

(51) Int. Cl.
*A42B 3/04* (2006.01)

(52) U.S. Cl. ..... 2/410; 2/411; 2/422

(58) Field of Classification Search ..... 2/455, 410, 2/5, 6.6, 411, 422, 425, 7
See application file for complete search history.

(56) References Cited

U.S. PATENT DOCUMENTS

| | | | | |
|---|---|---|---|---|
| 402,182 | A | 4/1889 | O'Connor | |
| 482,429 | A | 9/1892 | O'Connor | |
| 765,499 | A | 7/1904 | Martin | |
| 1,194,935 | A | 8/1916 | Bell | |
| 2,112,383 | A | 3/1938 | Sloan et al. | |
| 2,580,323 | A | 12/1951 | Russell | |
| 2,753,566 | A | 7/1956 | Perelman | |
| 3,302,018 | A * | 1/1967 | Harding | 362/106 |
| 3,496,854 | A | 2/1970 | Feldman et al. | |
| 4,231,079 | A | 10/1980 | Heminover | |
| 4,945,458 | A * | 7/1990 | Batts et al. | 362/106 |
| 5,093,937 | A | 3/1992 | Kamata | |
| 5,170,510 | A | 12/1992 | Nava | |
| 5,329,637 | A | 7/1994 | Walker | |
| 5,388,277 | A | 2/1995 | Taniuchi | |
| 5,485,358 | A | 1/1996 | Chien | |
| 5,564,128 | A * | 10/1996 | Richardson | 2/422 |
| 5,688,039 | A | 11/1997 | Johnson | |
| 5,758,947 | A | 6/1998 | Glatt | |
| 5,810,467 | A | 9/1998 | Hurwitz | |
| 5,855,023 | A | 1/1999 | Clingenpeel et al. | |
| 5,871,271 | A | 2/1999 | Chien | |
| 5,996,128 | A | 12/1999 | Yanagihara | |
| 6,105,172 | A | 8/2000 | Shida | |
| 6,122,773 | A * | 9/2000 | Katz | 2/171.3 |
| 6,151,718 | A | 11/2000 | Shirai | |
| 6,170,090 | B1 * | 1/2001 | Minor | 2/411 |
| 6,244,721 | B1 | 6/2001 | Rodriguez et al. | |
| 6,263,513 | B1 | 7/2001 | Murakami | |
| 6,325,521 | B1 | 12/2001 | Gregg et al. | |
| 6,328,454 | B1 | 12/2001 | Davis | |
| 6,609,913 | B1 * | 8/2003 | Batts | 434/226 |
| 6,823,531 | B1 | 11/2004 | Chen | |
| 6,910,228 | B2 | 6/2005 | Tanaka | |
| 6,961,963 | B2 | 11/2005 | Rosie | |
| 7,075,250 | B2 * | 7/2006 | Colwell | 315/291 |

(Continued)

*Primary Examiner* — Christopher Harmon
(74) *Attorney, Agent, or Firm* — Gene Scott; Patent Law & Venture Group

(57) ABSTRACT

A hardhat provides ventilation and controlled lighting. A crown of a modified semi-spherical shape terminates downwardly with a generally oval peripheral edge in a horizontal plane, the crown having a plurality of apertures therein arranged in spaced apart sequence, and a flexible venting strip fixed forwardly on the crown and extending over the apertures, the venting strip positionable in each of a plurality of arcs above the crown, wherein each one of the arcs provides a selectable ventilation conductance into the hardhat. A brim is joined integrally to the peripheral edge of the crown extending outwardly. An electrical circuit has components including: a head-lamp mounted forward on the hardhat, a series of individual lights mounted in spaced-apart positions circumventing the crown, and a manual control mounted on the brim, the manual control is enabled for setting the electrical circuit in a standard operating mode wherein the head-lamp and individual lights are activated, and in a distress operating mode wherein the individual lights are red in color and set to blinking, and in an emergency mode wherein a loudspeaker and radio distress beacon are activated.

7 Claims, 4 Drawing Sheets

U.S. PATENT DOCUMENTS

| | | | | |
|---|---|---|---|---|
| 7,121,676 | B1 * | 10/2006 | Kutnyak | 362/105 |
| 7,200,873 | B2 | 4/2007 | Klotz et al. | |
| 7,304,442 | B2 * | 12/2007 | Colwell | 315/307 |
| 7,311,413 | B1 | 12/2007 | Barnes | |
| 7,534,005 | B1 * | 5/2009 | Buckman | 362/105 |
| 7,827,624 | B1 * | 11/2010 | Cole | 2/458 |
| 2002/0159250 | A1 | 10/2002 | Kuo et al. | |
| 2004/0090769 | A1 | 5/2004 | Milton | |
| 2004/0250339 | A1 | 12/2004 | Musal | |
| 2005/0174753 | A1 | 8/2005 | Cao et al. | |
| 2007/0226879 | A1 | 10/2007 | Plastino | |
| 2007/0238405 | A1 | 10/2007 | Arai | |

* cited by examiner

HARDHAT WITH VENT STRIP AND LIGHTING CONFIGURATION

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

SEQUENCE LISTING

Not applicable.

BACKGROUND OF THE INVENTION

1. Field of the Present Disclosure

This disclosure relates generally to head gear used for protection as for instance helmets of various kinds such as those worn in sporting games, for example football, baseball and hockey, and those worn when using dangerous equipment such as skate boards, bicycles and motorcycles, and those worn by construction and mining workers. This disclosure relates more specifically to a workers hard hat that provides illumination and is able to provide various signals such as when in distress by those working in low light areas such as mines, or at night, as for instance when working on highway construction projects.

2. Description of Related Art Including Information Disclosed Under 37 CFR 1.97 and 1.98

Plastino, US 20070226879, discloses a helmet having a vent assembly allowing fluid communication between an exterior of the helmet and an interior of the helmet. The vent assembly includes an open-ended elongated sleeve disposed on a frontal portion of the helmet, with the sleeve being in fluid communication with at least one aperture passing through to the helmet interior. In one embodiment, the elongated sleeve includes a first wall having at least one aperture therethrough, a second wall spaced from the first wall and having at least one aperture therethrough, at least one closed edge, and at least one open edge, defining an internal lumen. The at least one first wall aperture, at least one second wall aperture, and at least one inner shell aperture cooperate to allow fluid communication between an exterior and an interior of the helmet. An insert slidably receivable within the elongated sleeve lumen is provided.

Cao et al., US 20050174753, discloses a mining light having a semiconductor light source such as an LED or laser, a heat sink, a magnetic switch, a light reflective and focusing cone, and other features.

Musal, US 20040250339, discloses a helmet for protecting the head of a wearer during sporting activities, comprising a protective shell, vents formed in the protective shell, and a shutter plate positioned within the protective shell. The shutter plate has apertures conforming in dimension and position to the vent openings so that the apertures are in substantial alignment with the vents when the shutter plate is in a first position. The shutter plate is selectively moveable so that the vents are opened or closed.

Milton, US 20040090769, discloses a bicycle helmet with small safety lights built into the outer rim of the helmet.

Kuo et al., US 20020159250, discloses a safety hat having a plurality of soft or hard light emitting strips, and a control switch. The hat body is like a shade. The soft light emitting strips are adhered on the surface and two lateral sides of the hat body. The battery is formed on the soft light emitting strips. One end of the control switch is connected to an electrode of the battery, and another end thereof is connected to the power supply end of the light emitting strip. By the action of the control switch, the soft light emitting strip lights up or becomes extinguished.

Barnes, U.S. Pat. No. 7,311,413, discloses a lighting device for use with a helmet, having a fastening site and a plurality of lamps. A base member is employed and includes at least one support holding at least one lamp. A flexible sheath extends over the support, the lamp, and at least a portion of the base member to form an enclosure. The sheath possesses an opening to allow light to pass from the lamp to the exterior of the sheath. The sheath also includes an outer surface of frictional material to allow the sheath to be frictionally fixed in at least a first and second position at the surface of the helmet. A fastener links the sheath to the helmet.

Chen, U.S. Pat. No. 6,823,531, discloses a helmet with ventilation having at its front multiple slot air inlets; a circular air passage connected through those slot air inlets being provided to the peripheral of an inner lining; multiple expel holes connected through the interior of the helmet being provided to the air passage; an air outlet being provided on the rear of the helmet; an air inlet lid being covered up those slot air inlets; and an air inlet gate allowing air flow adjustment.

Davis, U.S. Pat. No. 6,328,454, discloses a lighting device for a safety helmet or the like used for recreational and industrial purposes wherein a plurality of blinking LEDs are disposed on the outer surface of the helmet. The only circuitry needed is a 3 volt battery, an On-Off Switch and wiring for interconnecting the LEDs.

Gregg et al., U.S. Pat. No. 6,325,521, discloses a circuit on a curved surface where the circuit includes at least one circuit element on the curved surface, at least one conductive path on, and integral with, the curved surface, where the conductive path is connected to the circuit element, and circuitry for supplying power along the conductive path to the circuit element. The curved surface may be a helmet, in which case a plurality of pairs of light emitting elements may be provided thereon where the pairs emit light sequentially one pair at a time in order to maximize the brightness of the light emitted and maximize battery life. Also, a receiver for an infrared or ultrasonic signal may be provided such that the light emitting elements emit light in a certain manner as a result of the signal being received. Also provided is a method of forming at least one conductive path on a curved surface, such as on a helmet, where the method comprises aiming a beam of light to the curved surface, providing relative movement between the beam of light and the curved surface causing the beam of light to form a path on the curved surface, and laying conductive material on the path. The beam of light may be aimed at a mirror which bends the beam of the light to the curved surface, and the mirror may be moved by a stepper motor controlled by a computer. In addition, the curved surface may be moved by a stepper motor controlled by the computer.

Murakami, U.S. Pat. No. 6,263,513, discloses a helmet with a ventilating function including: a helmet shell having on an outer surface thereof a longitudinally extending outside air path is configured to introduce outside air thereinto from a front air inlet and discharge the same rearwardly from a rear air outlet to form an outside air flow that sucks inside air remaining in the helmet shell by its negative pressure to achieve ventilation. A path defining body defining the outside air path; and a rear deflector for facilitating release of an air flow from a rear portion of the outer surface of the helmet shell is functional in this helmet, the path defining body and the rear deflector being unified in the configuration.

Rodriguez et al., U.S. Pat. No. 6,244,721, discloses an automatic illuminated helmet comprising at least one light source that is automatically activated by an activation device. The activation device is a pressure switch located within the helmet. In this design, as the switch contacts the user's head, the light source will be activated. Hence, when the helmet is worn, activation will occur. In an alternative embodiment, a photovoltaic panel is used to re-charge the power supply.

Shirai, U.S. Pat. No. 6,151,718, discloses a safety cap which is lightweight and excellent in air ventilating ability and is waterproof. The safety cap includes an air hole penetrating inner and outer walls of a cap body, a drainage channel provided along the inner wall of the cap body for discharging water coming into the cap body through the air hole to outside of the cap body, and a vent hole in an upper side of a cross section of the drainage channel perpendicular to the drainage direction. Alternatively the safety cap includes a drainage groove formed in the outer surface of a cap body and having a plurality of vent holes formed in the side walls thereof, wherein the drainage groove is covered with a cover body having air holes and also an edge section of the drainage groove is opened to an outside of the cap body as a drainage hole. And the safety cap is provided with a recessed portion on a surface of the cap body, wherein the recessed portion has vent holes respectively penetrating the inner and outer walls thereof, and the recessed portion is covered with a cover body having air holes and drainage holes provided at positions where the holes do not overlap the vent holes.

Chien, U.S. Pat. No. 5,871,271, discloses protective headwear having a hard-shell outer layer and a protective shock absorbing layer including at least one LED illumination arrangement fitted into recesses in the protective layer and visible through a partially transparent area of the hardtop shell in any desired pattern or combination of lighting elements, the illumination arrangement includes an optical member which serves to optically increase the viewing angle and at the same time deflect or distribute the force of impacts away from the LED and thereby decrease the possibility of LED penetration through the helmet and into the head of the wearer. A control circuit in the form of a multiple function integrated circuit controller in which the on/off times and sequences for individual LEDs is switchable, either by means of switches which can be operated by the wearer of the helmet, or during assembly by means of simple circuit components connected to appropriate input pins of the controller, so as to achieve any desired combination of special effects is provided.

Hurwitz, U.S. Pat. No. 5,810,467, discloses an illuminated protective hat including at least one eletroluminescent lamp secured to a shell of the protective hat, which is powered by a power unit housed in a power unit portion of the protective hat shell, where the power unit includes a rechargeable battery. A retrofit unit including at least one electroluminescent lamp and power unit portion, to retrofit existing protective hats with the electroluminescent lamp and power unit portion. Both the electroluminescent lamp and the power unit portion of the retrofit unit can be either permanently or temporarily secured to a protective hat.

Glatt, U.S. Pat. No. 5,758,947, discloses an illuminated safety helmet including a protective core and a first layer disposed on the protective core. The first layer is a substrate or an impact resistant shell. A plurality of light emitting diodes and traces for electrically connecting the light emitting diodes are disposed on the substrate or impact resistant shell. As such, when the substrate or impact resistant shell is disposed on the core, the light emitting diodes are automatically disposed around the protective core. The illuminated safety helmet also includes control circuitry for illuminating the light emitting diodes and a power source for powering the control circuitry and the light emitting diodes.

Johnson, U.S. Pat. No. 5,688,039, discloses that a safety helmet has a battery operated, flashing rear light for wide angle visibility and a battery operated front light with a narrow projected forward beam to light the path being traversed. The front light pivots about a horizontal axis with manual control to adjust the attitude or inclination of the beam to enhance its utility.

Chien, U.S. Pat. No. 5,485,358, discloses that a lighting arrangement for head-wear that is made up of several light emitting diodes mounted on a flexible plate. The flexible plate is one of the straps of the length-adjustable belt conventional provided at the rear of a cap. The strap on which the LED is mounted may be stitched to the rear of the cap in conventional fashion and used for length adjustment purposes or may alternatively by stitched to the side of the cap to be used solely as a mounting for the lighting arrangement.

Walker, U.S. Pat. No. 5,329,637, discloses that the present invention relates to an improved fireman's helmet which includes a surrounding wall structure that defines a head receiving area therein. Mounted within the head receiving area and recessed in the wall structure are front and rear light assemblies as well as a battery pack and control panel.

Heminover, U.S. Pat. No. 4,231,079, discloses an article of wearing apparel such as a rigid opaque hat which has light emitting diodes mounted therein for being viewed, the terminals of the diodes and the circuitry for controlling the same being concealed within the article of apparel or on the person of the wearer. Control circuitry includes an electronic clock which sends electric pulses to an electronic counter, the output of which passes through a decoder which controls which diodes are sequentially illuminated to create an illusion of motion for getting the attention of others or for providing a type of theatrical ornamentation for the user.

Sloan et al., U.S. Pat. No. 2,112,383, discloses a pith helmet type of headgear with a vent at the top peak of the crown of the helmet.

The related art described above discloses hats and helmets of various types and clearly shows that it is know to add ventilation and lighting schemes for advanced utility. Such lighting is shown to be known to be used for illumination and for signaling. However, the prior art fails to disclose or suggest the present invention which is a modified standard hard-hat configuration with novel ventilation and lighting schemes. The present disclosure distinguishes over the prior art providing a ventilation strip with novel features and an electrical lighting circuit that provides unique capabilities critical to personnel safety under selected working conditions.

BRIEF SUMMARY OF THE INVENTION

This disclosure teaches certain benefits in construction and use which give rise to the objectives described below. The present invention is preferably configured as a conventional construction worker's hard hat, but may take other headgear configurations. A conventional hard hat is a type of helmet predominantly used in workplace environments, such as construction sites, to protect the head from injury by falling objects, debris, bad weather, and electric shock. Inside the helmet is a suspension that spreads the helmet's weight over the top of the head. It also provides a space of approximately 30 mm (1.2 inch) between the helmet's shell and the wearer's head so that if an object strikes the shell, the impact is less likely to be transmitted directly to the skull. Sometimes the helmet shell has a midline ridge. They are typically required personal protective equipment where heavy labor is being performed. They were originally made from metal, then fiberglass, but from the 1950s rigid plastic has been the most common material of its construction. Some contemporary cap-style hard hats feature a rolled edge that acts like a rain gutter to channel rainwater to the front, allowing it to drain off the bill, instead of letting the water run down the wearer's neck. Hard hats may be fitted with a visor, ear protectors, an eye shield or goggle, mirrors for improved rear field-of-view, a lamp for forward illumination and a chinstrap. The present invention preferably may have all of the above features and further includes an improved ventilation system and an illumination and visual lighting system for signaling. Emergency signaling is also provided and activated based on environmental and other conditions.

A primary objective inherent in the above described apparatus and method of use is to provide advantages not taught by the prior art.

Another objective is to provide a hard hat device with an advanced ventilation system with selectable air flow conductance.

A further objective is to provide such a hard hat device with an advanced lighting system visible from all directions.

A still further objective is to provide such a hard hat device with selectable modes of operation including standard lighting, red blinking lighting and radio beacon and loudspeaker activation.

A yet further objective is to provide such a hard hat device wherein external conditions may be sensed and used to active an emergency mode of operation.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawings is at least one of the best mode embodiments of the present invention In such drawings.

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present apparatus and its method of use.

Figure 1:
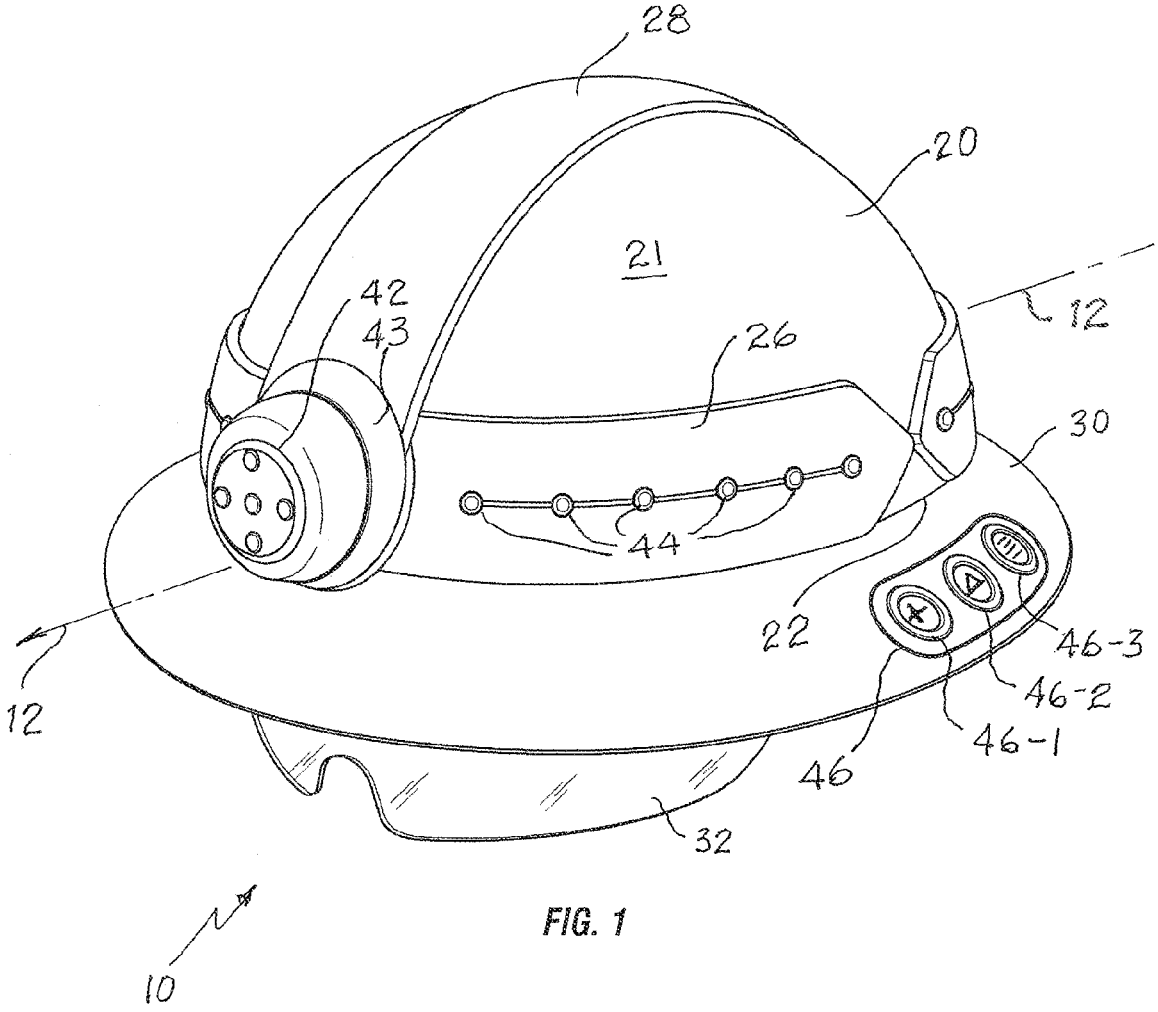
FIG. 1 is a front perspective view of the presently described apparatus showing a ventilation feature in a closed attitude.
Figure 2:
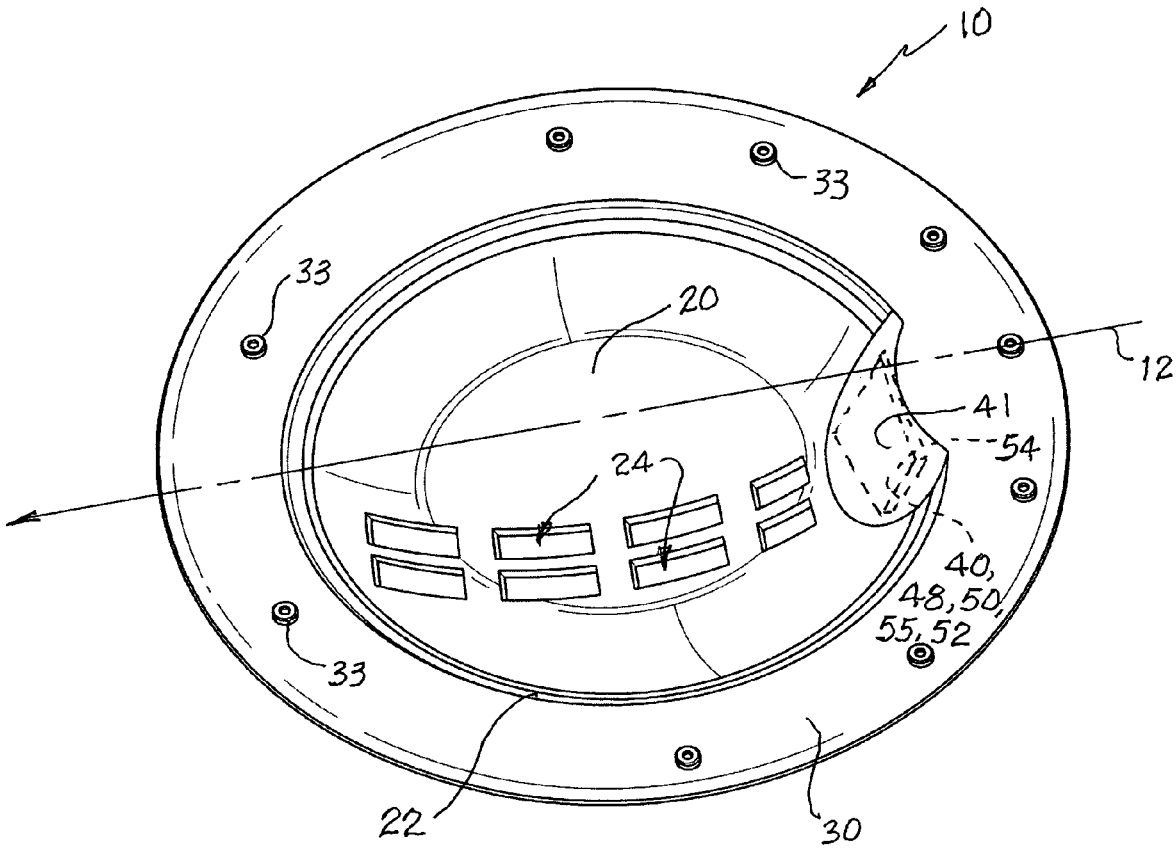
FIG. 2 is a bottom perspective view thereof showing further details of the ventilation feature.
Figure 3:
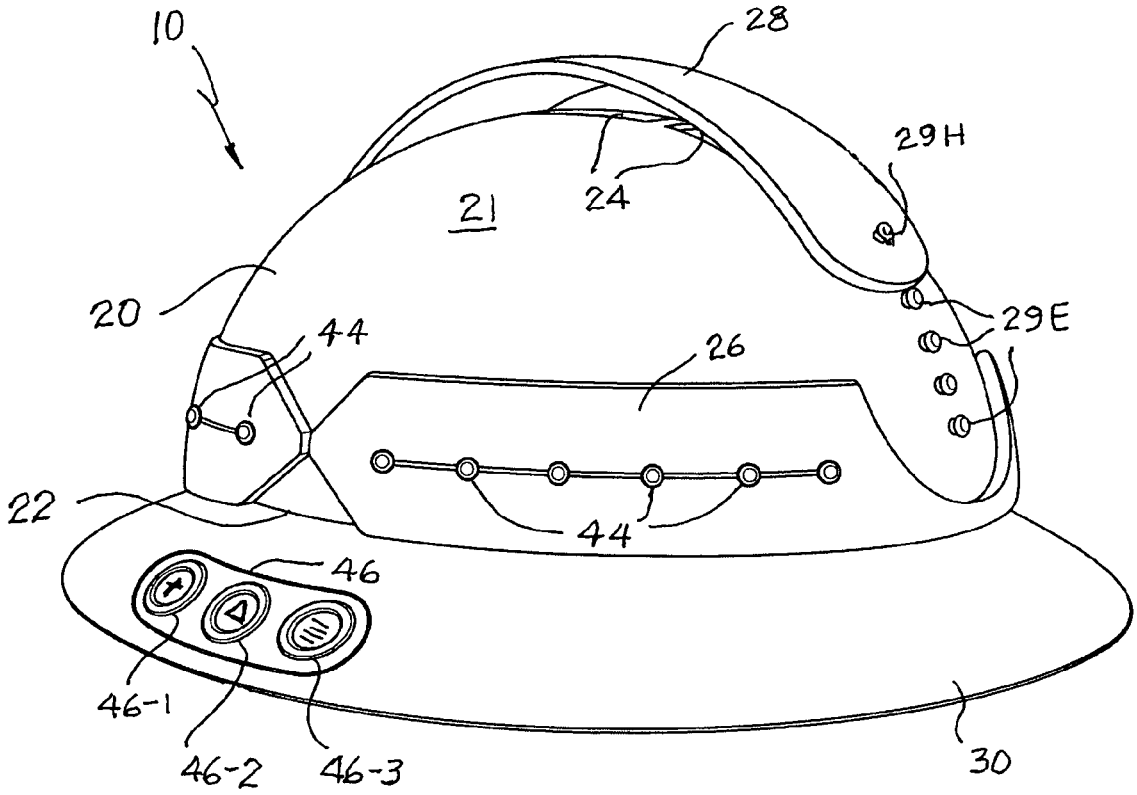
FIG. 3 is a rear and side perspective view thereof showing the ventilation feature in an open attitude.

The present invention is described now in detail; a hardhat 10 as shown in the drawing figures. Hardhat 10 has a crown 20 of a modified semi-spherical shape terminating downwardly with a generally oval peripheral edge 22 which terminates in a horizontal plane (not shown). As shown in FIG. 2, the crown 20 has a plurality of apertures 24 therein arranged in spaced apart positions across the crown 20 and along a centerline 12 of the hardhat 10. The terms "forward" and rearward," as used herein, refer to the orientation of the hardhat 10 when worn on the head and centerline 12 extends from the rearward to the forward positions of the crown 10 splitting the crown 10 into left and right halves separated by a vertical plane (not shown). A puggaree 26 (hat band) extends exteriorly around the crown 20 in alignment with the peripheral edge 22. Referring now to FIGS. 1 and 3, a flexible venting strip 28 is fixed at one end thereof forward on the outer surface 21 of crown 20 and extends, separated from crown 20, along the centerline 12 over the apertures 24. The venting strip 28 is positionable in an abutting relationship with outer surface 21 so as to seal the apertures 24; or in any one of a plurality of arcs above the crown 20 to provide a desired ventilation conductance as shown by example in FIG. 3. The crown 20 and the venting strip 28 have a mutually engagable fastener system enabling the venting strip 28 to assume the plurality of arcs above the crown 20. This is accomplished using a linear array of embossments 29E on the crown 20 and arrayed along center line 12, wherein each one of the embossments 29E is engagable with a hole 29H in venting strip 28, thereby securing the venting strip 28 in a selected one of said plurality of arcs.

A peripheral brim 30 is joined integrally to the peripheral edge 22 and the puggaree 26 of the crown 20, wherein the brim 30 extends outwardly therefrom, as is typical of a standard hardhat, and away from the crown 20 at an angle preferably tilted downwardly below the horizontal plane so as to accommodate water runoff.

An eye shield 32 may be attached to brim 30 by an eye-shield mounting means engaging the eye shield 32 whereby the eye shield 32 is removably attachable to an underside of the brim 30 in a forward position on the hardhat 10 as shown in FIG. 1. Such a mounting means may be the simple snap fasteners 33 shown in FIG. 2 or other common attachment means known in the art. As shown in FIG. 2 also, are seven further snap fasteners 33 which may be used for attachment of a neck protective curtain (not shown) as is well known in the art and often used with hardhats in general.

Figure 4:
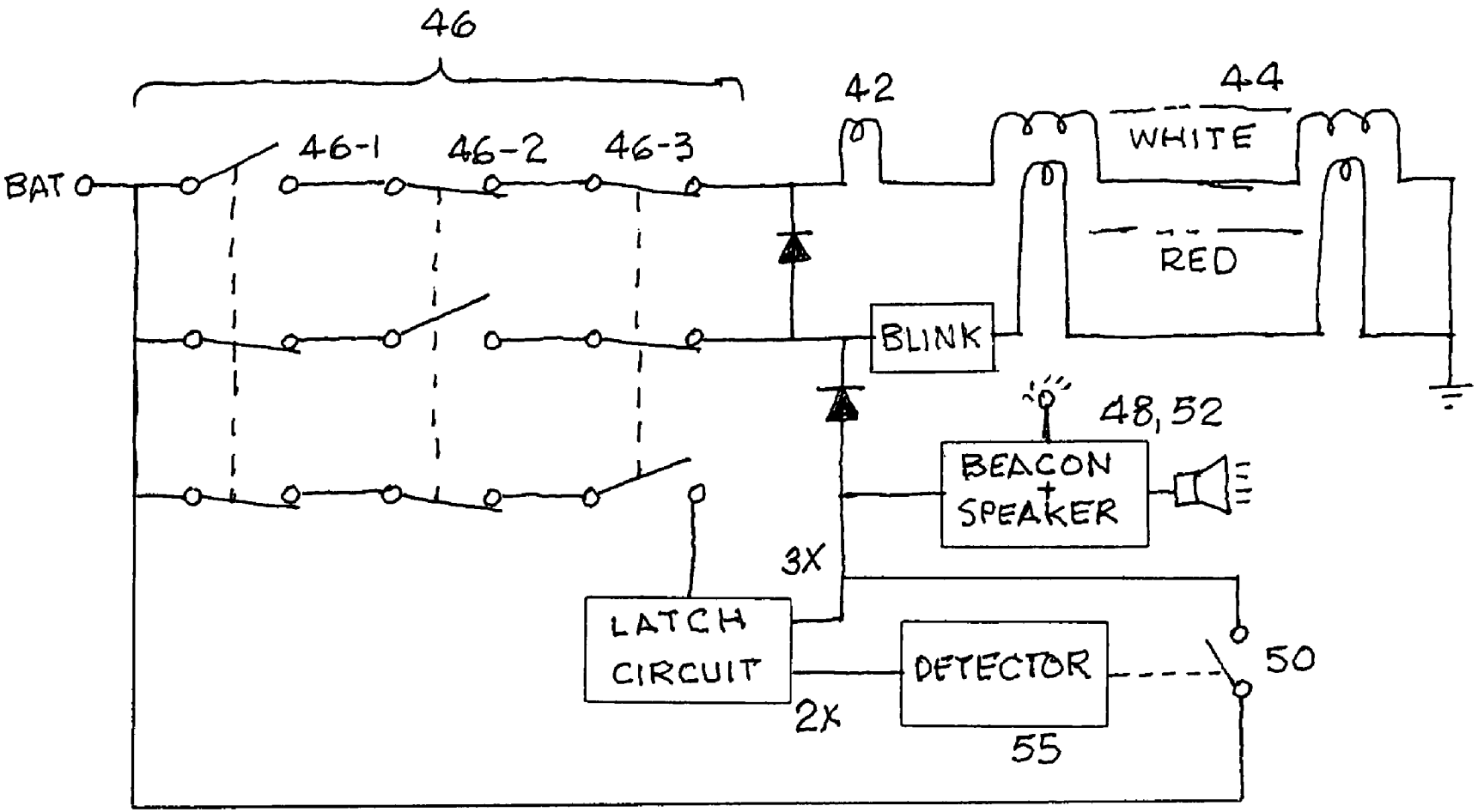
FIG. 4 is an electrical schematic diagram thereof showing details of illumination and signaling systems thereof.

An electrical circuit of the present invention (FIG. 4) is operated by a controller circuit board 40 (FIG. 2) including, or interconnected with, circuit components including: a head-lamp 42, a series of individual lights 44, a manual mode selector 46, a radio beacon 48, an automatic emergency switch 50 a detector 55, a loudspeaker 52, and an electrical battery 54. The circuit board 40 is secured in a rear pouch 41 in the crown 20 as shown in FIG. 2 and is accessible for replacement of battery 54. Circuit board 40 is interconnected with the circuit components by conductive paths (not shown) mounted within the crown 29 and brim 30 by wires and other means well known in the art. The head-lamp 42 is mounted forward on the puggaree 26 and centered on the centerline 12 as best shown in FIG. 1. The series of individual lights 44 are mounted on the puggaree 26 in spaced-apart positions, as shown, circumventing the crown 10. The radio beacon 48, automatic emergency switch 50, detector 55, and the loudspeaker 52 are preferably mounted on and secured to the circuit board 40 but one or another of these components may be located off the board 40, in pouch 41, or elsewhere in the hardhat 10. The electrical battery 54 is also mounted within the rear pouch 41 and is preferably secured to the circuit board 40 as well. Preferably, the head-lamp 42 is secured within a peripheral ring 43 in such a manner, as for instance by a gambles arrangement, as to be able to swivel from side-to-side and up or down so that a beam of light from the head-lamp 42 may be directed to a selected target or subject by merely moving the head-lamp 42 without moving the hardhat 10 or one's head. Gimbals mountings are well known in the art but not with hardhat head-lamps.

The manual mode selector 46 is mounted on one side of the brim 30 and is comprised of three buttons 46-1, 46-2, 46-3, each easily operated by a finger press. Each of the three buttons has an embossment on it as shown in FIGS. 1 and 3. Here the embossments are shown as "+" and "Δ" and "≡" but they may be any symbol that one can distinguish by feeling with the tip of a finger. These three buttons enable three modes of operation of the hardhat 10 including: (i) a standard operating mode (switch 46-1) wherein the head-lamp 42 and the series of individual lights 44 are illuminated in a non-red color and in a steady state, and this is the mode of operation of the hardhat 10 used during typical work operations, (ii) a distress mode (switch 46-2) wherein the series of individual lights 44 are illuminated in a red color and are set to continuously blink, and this is the mode of operation that a worker would use if in distress, or simply to request help with a difficult or dangerous operation, and (iii) an emergency mode (EM) which is identical to the distress mode, but further includes activation of the radio beacon 48 and loudspeaker 52 wherein an alarm sound such as a siren produces is continuously emitted. The radio beacon 48 transmits a continuous and intermittent beep on one of the international distress frequencies. The EM may be set to standby or active. When the switch 46-3 is depressed only once, there is no effect, but when depressed twice in quick succession, standby EM is entered but will only move to active EM when a selected event takes place while still in standby EM and such selected event triggers automatic emergency switch 50. Active EM may alternately be manually entered by depressing switch 46-3 three times in quick succession. Automatic emergency switch may be activated by a broad range of events depending upon the service that the hardhat 10 is pressed into. Such an event may be, for instance, an inertial event such as would occur when the hardhat 10 falls to the ground, rotates several times, rolls or slides on a surface, etc. This is intended to detect that the person wearing the hat has fallen. The detector 55 may be other than an inertial sensor, as for example it may be an oxygen detector that determines when the level of oxygen in the air in a mine shaft, for instance, is below acceptable level. Sensor 55 may be a carbon dioxide level detector or any other well known detector of molecular airborne species, a thermal sensor, a pressure sensor and so on. When Sensor 55 detects a condition that is not acceptable, it triggers switch 50 and initiates active EM no matter which mode hardhat 10 is currently in.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A hardhat with ventilation and controlled lighting, the hardhat comprising:

a crown of a modified semi-spherical shape terminating downwardly with a generally oval peripheral edge in a horizontal plane, the crown having a plurality of apertures therein arranged in spaced apart sequence, and a flexible venting strip fixed forwardly on the crown and extending over the apertures, the venting strip positionable in each of a plurality of arcs above the crown, wherein each one of the arcs provides a selectable ventilation conductance into the hardhat;

a brim joined integrally to the peripheral edge of the crown and extending outwardly therefrom;

an electrical circuit having components including: a head-lamp mounted forward on the hardhat, a series of individual lights mounted in spaced-apart positions circumventing the crown, and a manual control mounted on the brim, the manual control enabled for setting the electrical circuit in a standard operating mode wherein the head-lamp and individual lights are activated, and in a distress operating mode wherein the individual lights are red in color and set to blinking, and in an emergency mode wherein a loudspeaker and radio distress beacon are activated.

2. The hardhat with ventilation and controlled lighting of claim 1 wherein the electrical circuit is enabled for a standby emergency mode and an active emergency mode and for moving from the standby emergency mode into the active emergency mode upon detecting an environmental condition.

3. The hardhat with ventilation and controlled lighting of claim 1 wherein the electrical circuit is enabled for a standby emergency mode and an active emergency mode and for moving from the standby emergency mode into the active emergency mode upon detecting an inertial event.

4. The hardhat with ventilation and controlled lighting of claim 1 further comprising an eyeshield, the brim providing an eyeshield mounting means engaging the eyeshield whereby the eyeshield is removably fixed to an underside of the brim in a forward position on the hardhat for shielding eyes of a person wearing the hardhat.

5. The hardhat with ventilation and controlled lighting of claim 1 wherein the crown and the venting strip have a mutually engagable fastener enabling the venting strip to assume the plurality of arcs above the crown.

6. The hardhat with ventilation and controlled lighting of claim 1 wherein the head-lamp is secured within a peripheral ring thereby enabled with gimbaled movement.

7. The hardhat with ventilation and controlled lighting of claim 1 wherein the manual control has an embossment for non-visual switch selection.

* * * * *